US008839763B2

(12) United States Patent
Mittal

(10) Patent No.: US 8,839,763 B2
(45) Date of Patent: Sep. 23, 2014

(54) COMPRESSION IGNITION DUAL FUEL ENGINE AND FUEL INJECTOR FOR SAME

(71) Applicant: Caterpillar, Inc., Peoria, IL (US)

(72) Inventor: Mayank Mittal, Waukesha, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/763,931

(22) Filed: Feb. 11, 2013

(65) Prior Publication Data

US 2014/0123948 A1 May 8, 2014

Related U.S. Application Data

(63) Continuation of application No. 13/667,773, filed on Nov. 2, 2012, now abandoned.

(51) Int. Cl.
*F02M 43/04* (2006.01)
*F02B 7/06* (2006.01)
*F02D 19/10* (2006.01)

(52) U.S. Cl.
CPC ..... *F02M 43/04* (2013.01)
USPC ..... 123/304; 123/575

(58) Field of Classification Search
USPC ..... 123/299, 300, 304, 456, 575–578, 123/27 GE, 526; 239/96, 408–410, 585.1
See application file for complete search history.

(56) References Cited

U.S. PATENT DOCUMENTS

| | | | | | |
|---|---|---|---|---|---|
| 4,499,862 | A * | 2/1985 | Baumer et al. | ..... | 123/1 A |
| 4,700,672 | A * | 10/1987 | Baguena | ..... | 123/299 |
| 4,856,713 | A * | 8/1989 | Burnett | ..... | 239/113 |
| 6,073,862 | A | 6/2000 | Touchette et al. | | |
| 6,431,471 | B2 | 8/2002 | Anzinger et al. | | |
| 6,745,958 | B2 * | 6/2004 | Lei | ..... | 239/585.2 |
| 7,556,017 | B2 * | 7/2009 | Gibson | ..... | 123/299 |
| 2004/0256495 | A1 * | 12/2004 | Baker et al. | ..... | 239/533.2 |
| 2006/0086825 | A1 * | 4/2006 | Date et al. | ..... | 239/408 |
| 2007/0169741 | A1 * | 7/2007 | Vachon et al. | ..... | 123/294 |
| 2009/0020631 | A1 * | 1/2009 | Mashida et al. | ..... | 239/533.3 |

* cited by examiner

*Primary Examiner* — Mahmoud Gimie
(74) *Attorney, Agent, or Firm* — Leill & McNeil

(57) ABSTRACT

A compression ignition dual fuel engine utilizes individual fuel injectors to inject both gaseous and liquid fuels into each engine cylinder. Each of the fuel injectors includes two electrical actuators that control pressure in a respective liquid control chamber and gaseous control chamber to control the opening movement of check valves to facilitate liquid and gaseous fuel injection events, respectfully. The control fluid for liquid injection events is liquid, whereas the control fluid for the gaseous injection event is gaseous. The used liquid fuel drained from each fuel injector is returned for recirculation and subsequent injection, whereas the used gaseous fuel that drains from the fuel injector is supplied to the intake manifold for burning as circumstances permit.

20 Claims, 6 Drawing Sheets

COMPRESSION IGNITION DUAL FUEL ENGINE AND FUEL INJECTOR FOR SAME

TECHNICAL FIELD

The present disclosure relates generally to compression ignition dual fuel engines that utilize liquid and gaseous fuels, and more particularly to a fuel injector structure that reduces sensitivity to pressure differences between the two fuels.

BACKGROUND

One class of engines utilize a small pilot injection quantity of liquid diesel fuel that is compression ignited to in turn ignite a larger charge of gaseous fuel. Because of spatial constraints in and around engine cylinders, there has been an effort to supply both of the fuels to each engine cylinder via individual fuel injectors with the ability to inject both gaseous and liquid fuels. U.S. Pat. No. 6,073,862 to teaches such a fuel injector for use in a compression ignition engine. The '862 reference also teaches that injection events are controlled with two separate electrical actuators that control fluid pressure in control chambers that allow for the direct control of the opening and closing of separate check valves to facility liquid and gaseous injection events, respectfully. The control chambers associated with both the gaseous fuel and the liquid fuel injection events are filled with liquid fuel. This reference teaches the inclusion of annulus of pressurized liquid fuel surrounding the check valve for the gaseous injection in order to inhibit leakage of gaseous fuel into the liquid side of the fuel system. Because liquid fuel is utilized to control both gaseous and liquid injection events, pressure fluctuations in the liquid fuel may undermine effective control of gaseous fuel injection events. In addition, leakage of liquid fuel into the gaseous side of the dual fuel system may present other problems.

The present disclosure is directed toward one or more of the problems set forth above.

SUMMARY

In one aspect, a dual fuel injector includes an injector body that defines a first fuel inlet, a second fuel inlet, a first nozzle outlet set, a second nozzle outlet set, a first drain outlet and a second drain outlet, and has disposed therein a first control chamber and a second control chamber. A first direct operating check valve has a first check valve member positioned in the injector body with a first closing surface exposed to fluid pressure in the first control chamber. The first check valve member is movable between a closed position in contact with a first seat to fluidly block the first fuel inlet to the first nozzle outlet set, and an open position out of contact with the first seat to fluidly connect the first fuel inlet to the first nozzle outlet set. A second direct operating check valve has a second check valve member positioned in the injector body with a second closing surface exposed to fluid pressure in the second control chamber. The second check valve member is movable between a closed position in contact with a second seat to fluidly block the second fuel inlet to the second nozzle outlet set, and an open position out of contact with the second seat to fluidly connect the second fuel inlet to the second nozzle outlet set. A first control valve member is movable between a closed position at which the first control chamber is fluidly blocked to the first drain outlet, and an open position at which the first control chamber is fluidly connected to the first drain outlet. A second control valve member is movable between a closed position at which the second control chamber is fluidly blocked to the second drain outlet, and an open position at which the second control chamber is fluidly connected to the second drain outlet.

In another aspect, a compression ignition dual fuel engine includes an intake manifold fluidly connected to a plurality of engine cylinders. A plurality of fuel injectors are each positioned for direct injection into one of the engine cylinders. Each of the fuel injectors includes an injector body that defines a liquid fuel inlet, a gaseous fuel inlet, a liquid nozzle outlet set, a gaseous nozzle outlet set, a liquid drain outlet and a gaseous drain outlet. Disposed within each fuel injector is a liquid control chamber and a gaseous control chamber. Each of the fuel injectors also includes a liquid direct operated check valve with a liquid check valve member. A gaseous direct operating check valve with a gaseous check valve member, a liquid control valve member and a gaseous control valve member. A gaseous fuel common rail is fluidly connected to the plurality of fuel injectors. A liquid fuel common rail is also connected to the fuel injectors. A gaseous fuel supply and pressure control system is fluidly connected to the gaseous fuel common rail. A liquid fuel supply and pressure control system is fluidly connected to the liquid fuel common rail. Each of the gaseous drain outlets is fluidly connected to the intake manifold. Each of the liquid drain outlets is fluidly connected to the liquid fuel supply and pressure control system. An electronic controller is in control communication with each of the plurality of fuel injectors, the liquid fuel supply and pressure control system, and the gaseous fuel supply and pressure control system.

In still another aspect, a method of operating the dual fuel compression ignition engine includes injecting liquid fuel through the liquid nozzle outlet set by fluidly connecting the liquid control chamber to the liquid drain outlet past the liquid control valve member. Gaseous fuel is injected through the gaseous nozzle outlet set by fluidly connecting the gaseous control chamber to the gaseous drain outlet past the gaseous control valve member.

DETAILED DESCRIPTION

Figure 1:
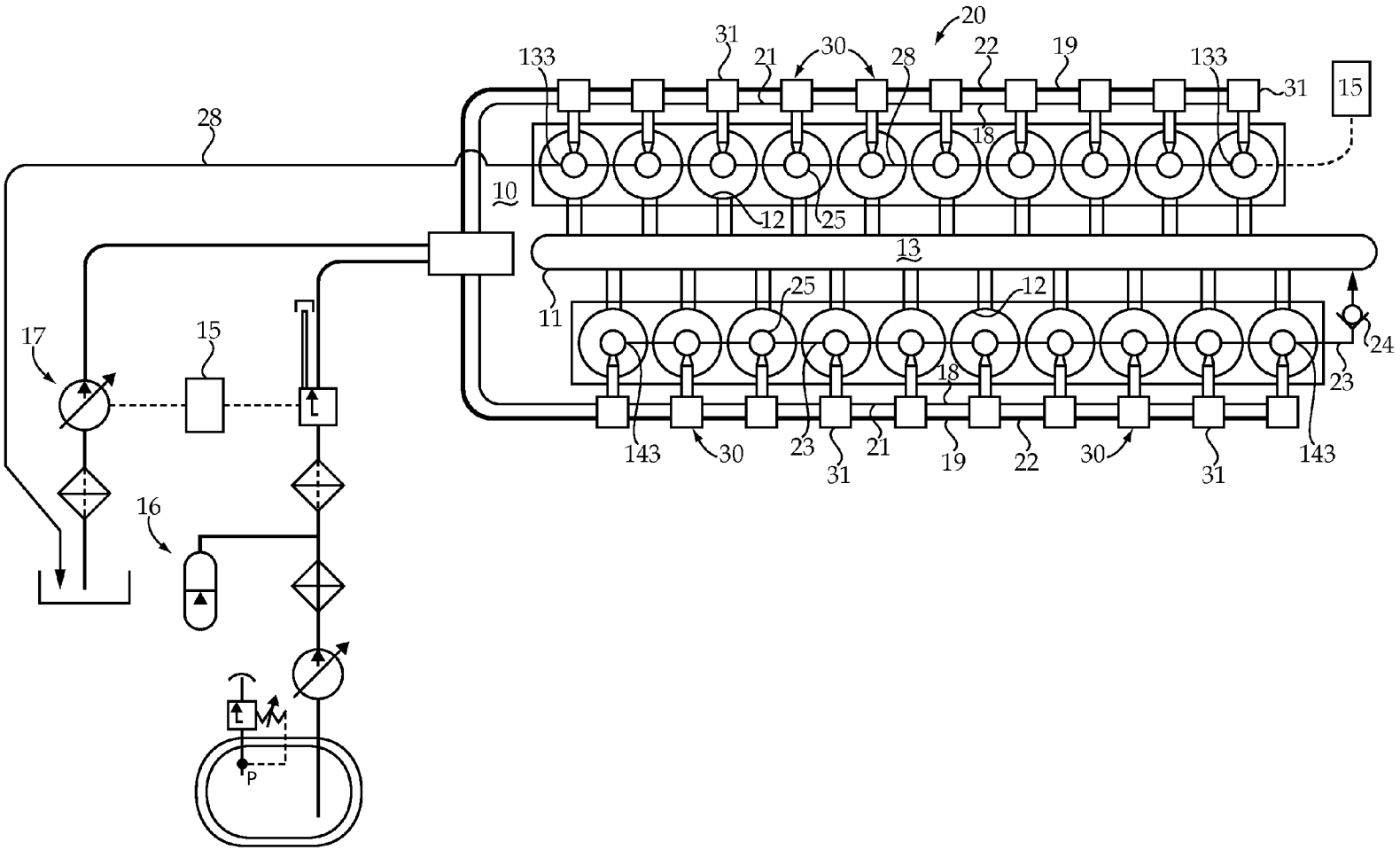
FIG. 1 is a schematic view of a dual fuel engine according to the present disclosure.
Figure 2:
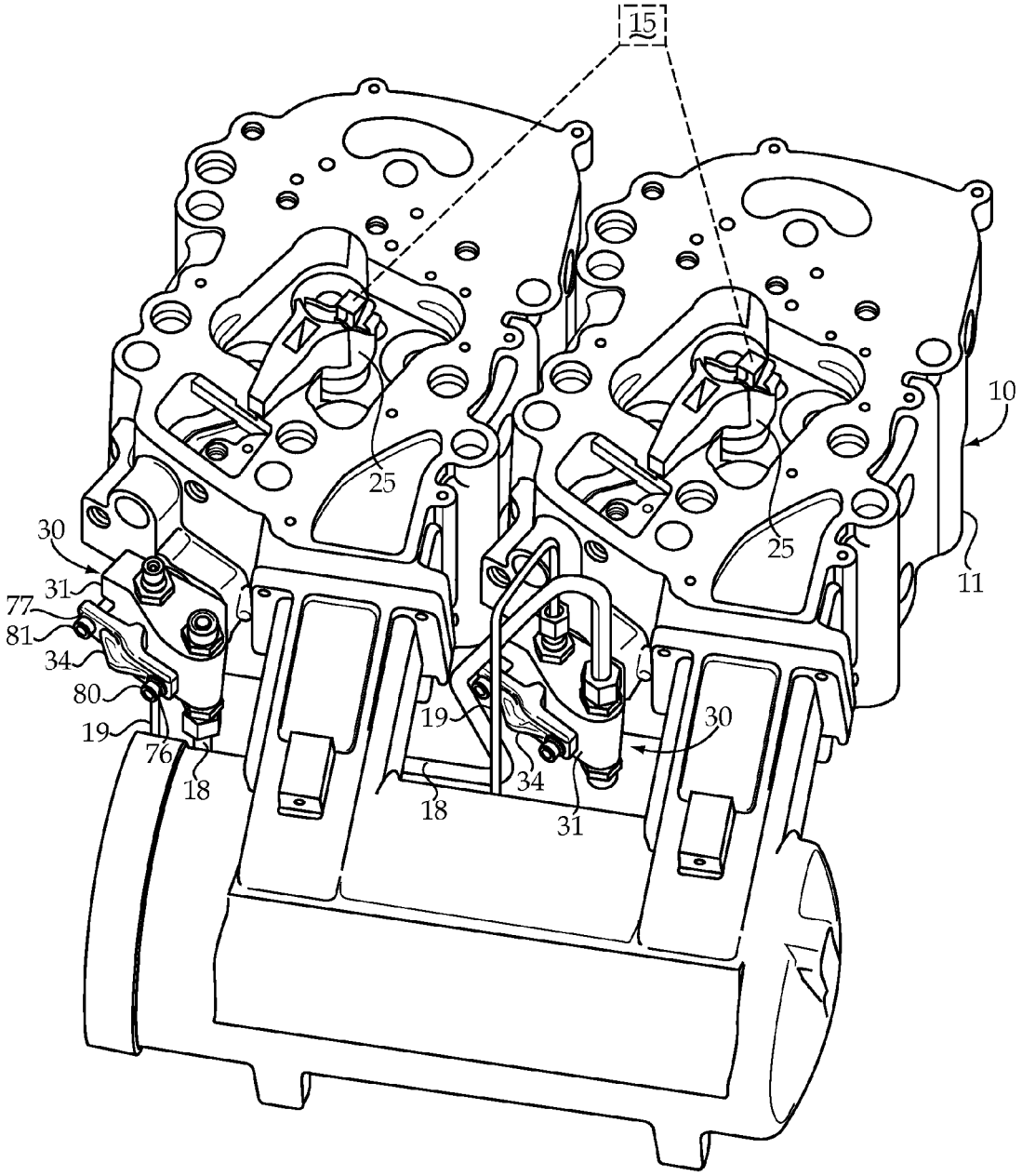
FIG. 2 is a perspective view of a portion of the engine and dual fuel common rail system for the engine of FIG. 1.
Figure 3:
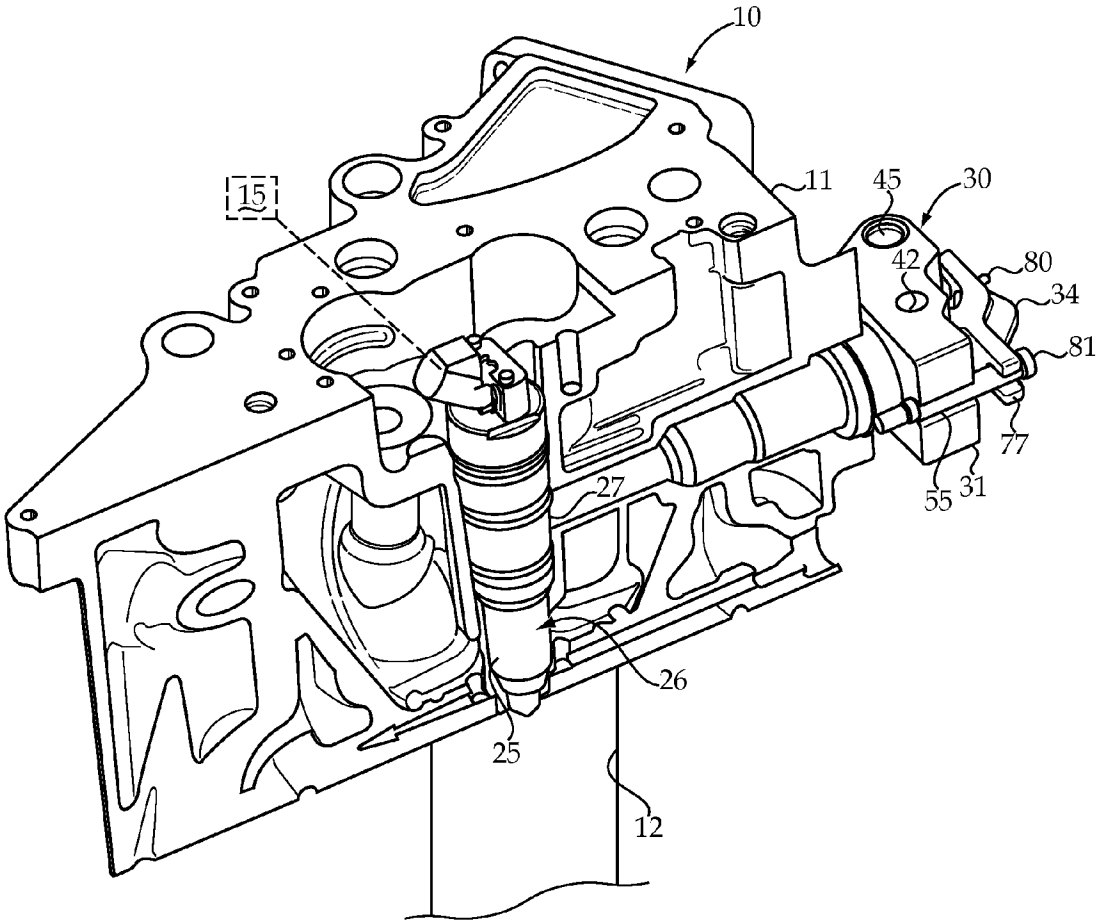
FIG. 3 is a sectioned perspective view of a portion of the engine housing shown in FIG. 2 to reveal structure for one fuel injector and engine cylinder.

Referring initially to FIGS. 1-3, a dual fuel engine 10 includes a dual fuel common rail system 20 mounted to an engine housing 11 that defines a plurality of engine cylinders 12. The dual fuel common rail system 20 includes exactly one fuel injector 25 positioned for direct injection into each of the plurality of engine cylinders 12. A gaseous fuel common rail 21 and a liquid fuel common rail 22 are fluidly connected to each fuel injector 25. The dual fuel common rail system 20 also includes gas supply and pressure control devices 16 fluidly connected to the fuel gaseous common rail 21, as well as liquid supply and pressure control devices 17 fluidly connected to the liquid for common rail 22. Each of the fuel injectors 25, the gas pressure supply and control devices 16 and the liquid supply and pressure control devices 17 are controlled by, and in communication with, an electronic engine controller 15 in a known manner. The gas supply and pressure control devices 16 may include a pressurized cryogenic liquid natural gas tank with an outlet fluidly connected to a variable delivery cryogenic pump. Devices 16 may also include a heat exchanger, an accumulator, a gas filter and a fuel conditioning module that controls the supply and pressure of gaseous fuel to gaseous fuel common rail 21. The liquid supply and pressure control devices 17 may include a diesel fuel tank, fuel filters and an electronically controlled high pressure fuel pump that supply liquid fuel to, and control pressure in, liquid fuel common rail 22.

Each of the fuel injectors 25 includes a gaseous drain outlet 143 that is fluidly connected to the intake manifold 13 by way of a gas passage 23. A valve 24, which could be a check valve or an electronically controlled valve, is positioned between gas passage 23 and intake manifold 13 to prevent the reverse flow of gas from intake manifold 13 into gas passage 23. Each of the fuel injectors 25 also includes a liquid drain outlet 133 fluidly connected to the tank of the liquid supply and pressure control system 17 by way of a liquid return line 28. For sake of clarity, only the end fuel injectors 25 in the upper bank have the liquid drain outlet 133 numerically identified, and only the end fuel injectors 25 in the lower bank have the gaseous drain outlet 143 numerically identified. Likewise, the liquid return line 28 is only shown with regard to the upper bank of fuel injectors 25, but is not shown for the lower bank of fuel injectors. Also for the sake of clarity, the gas passage 23 is only shown with regard to the lower bank of fuel injectors, but is not shown with regard to the upper bank of fuel injectors in FIG. 1.

As best shown in FIGS. 1 and 2, the blocks 31 of the co-axial quill assemblies 30 may be daisy-chained together with gaseous fuel line segments 18 and liquid fuel line segments 19 to define the gaseous fuel common rail 21 and the liquid fuel common rail 22, respectively. The last co-axial quill assembly 30 in the daisy-chain may have a set of plugs in place of the fittings shown in FIG. 2.

Figure 4:
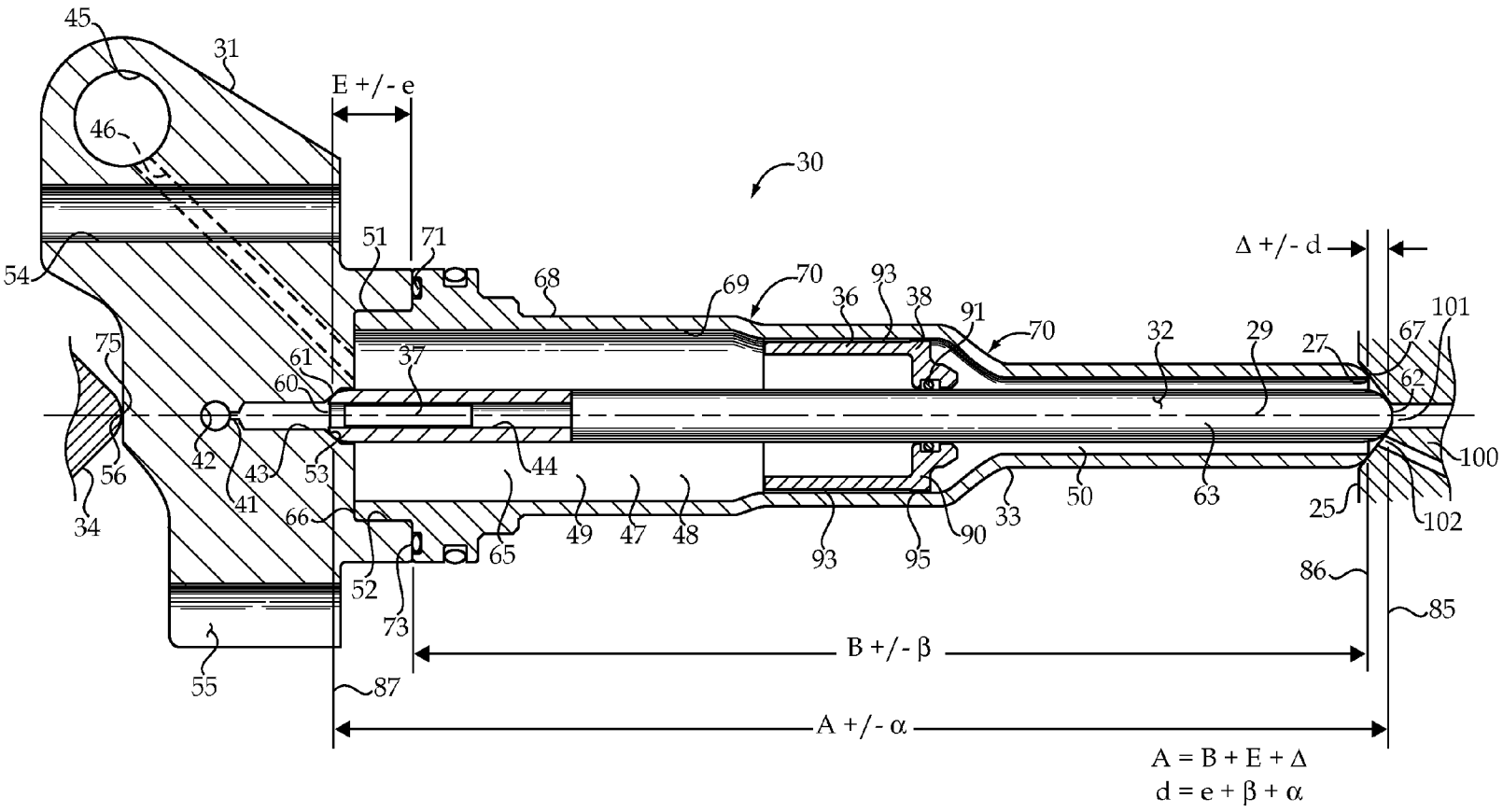
FIG. 4 is a sectioned side view through a co-axial quill assembly according to another aspect of the present disclosure.

Referring in addition to FIG. 4, the dual fuel common rail system 20 includes a co-axial quill assembly 30 with an inner quill 32 and an outer quill 33 in sealing contact with a common conical seat 27 of each fuel injector 25. In the illustrated embodiment, a pressure damping chamber 48 consists of an upstream segment 49 of the gaseous fuel conduit 47 that has a flow area at least several times larger than the downstream segment 50 of the gaseous fuel conduit 47. The gaseous fuel conduit 47 is fluidly connected to the gaseous fuel inlet 102 of each fuel injector 25. The pressure damping chamber 48 may be defined in each co-axial quill assembly 30 in order to damp pressure waves moving from gaseous fuel common rail 21 toward the respective fuel injector 25, especially during an injection event. The pressure damping chamber 48 has a volume greater than a gaseous fuel volume 26 (nozzle chamber, sac and gas passageways) within the respective fuel injector 25. Those skilled in the art will appreciate that the available space constraints on fuel injector 25 limit the size of the gaseous fuel volume 26 within each fuel injector 25. The gas volume 26 in each fuel injector may likely be many times less than a rated gaseous injection volume from injector 25.

One strategy for sizing the pressure damping chamber 48 may start with the continuity equation, and then derive an equation for the pressure response of a particular fluid (e.g. natural gas) in a specific volume (the pressure damping chamber 48) to a flow rate arriving (from the rail 21) to a flow rate leaving the volume (injection rate). The idea is to reduce the pressure change reaction to the volume flow of the fluid to a satisfactory level. The pressure damping chamber 48 should provide sufficient absorption of arriving pressure waves to damp out reflective transients. Thus, one might consider a maximum rated volume of gaseous fuel delivery for fuel injector 25 in the engine 10, and the gas injection pressure, and size a volume of the pressure damping chamber 48 that will provide sufficient absorption of the pressure waves.

Referring again to FIGS. 2-4, each co-axial quill assembly 30 may include a load adjusting clamp 34 with a pivot surface 75 in contact with a block 31 at a load adjustment location 56 that is intersected by the axis 29 of the inner quill 32. The load adjusting clamp 34 may define a fastener slot 77 and a fastener bore 76 that receive a first fastener 81 and a second fastener 80, respectively. The load adjustment clamp 34 pivots on load adjustment location 56 responsive to adjustments to the first and second fasteners 81, 80. Fastener 80 may include a spherical washer and bolt, while fastener 81 may be a shoulder bolt that is utilized to set an attitude of load adjustment clamp 34. For instance, the proper assembly may require connection of co-axial quill assembly 30 to engine housing 11 with first fastener 81. Bolt 80 can then be tightened to a pre-determined torque that assures proper seating seal contact between outer quill 33 and inner quill 32, independently but simultaneously, on common conical seat 27 of fuel injector 25. During this process, load adjustment clamp 34 will pivot through some limited small angle. The fasteners 80 and 81 are received in fastener bore 54 and fastener slot 55, respectively of blocks 31.

Each block 31 of each co-axial quill assembly 30 may define a gaseous rail passage 45 that is oriented perpendicular to the axis 29 of inner quill 32 and fluidly connected to a gaseous fuel passage 46 that opens at one end into a quill chamber 52 outside of conical seat 53. The gaseous rail passage 45 may extend completely through block 31 in order to facilitate the daisy chain connection structure shown in FIGS. 1 and 2. Each block 31 also includes a liquid rail passage 42, which may extend all the way through, and that is oriented perpendicular to the axis 29 and fluidly connected to a liquid fuel passage 43 that opens on one end into quill chamber 52 through conical seat 53. A segment of liquid fuel passage 43 may have an orifice segment 41, as shown, to reduce a flow rate from the liquid rail 22 to help manage transients in the liquid quill 32. The liquid fuel passage 43 is fluidly connected to the liquid fuel inlet 101 of each fuel injector 25. Both liquid fuel inlet 101 and gaseous fuel inlet 102 open through common conical seat 27 of each fuel injector 25. The minimum area required for the orifice 41 may be computed by dividing the total injection quantity by the injection duration, and sizing the orifice to allow that delivery with a minimum pressure drop. Thus, the sizing of that flow area may relate to the performance characteristics of fuel injector 25. The inner quill 32 defines a liquid fuel conduit 44 extending between a first end 60 and a second end 62. First end 60 includes an annular spherical surface 61 that rests in contact at a gage line 87 with, but remains unattached to, the conical seat 53, and a gage line 85 on an annular spherical surface at second end 62 in contact with common conical seat 27 of fuel injector 25. The outer quill 33 has a hollow interior 65 separating a first end 66 from a second end 67. The first end 66 is received in the quill chamber 52, and the outer quill 33 may be attached to block 31 with mating threads 51.

Practical manufacturing limitations may forbid mass production of co-axial quill assemblies 30 in which either the inner quill 32 or the outer quill 33 are integrally formed with block 31, or each other. Thus, an annular seal 71 serves to seal against leakage of gaseous fuel from between block 31 and outer quill 33 of co-axial quill assembly 30. In this embodiment, annular seal 71 includes an o-ring 73 in a face seal configuration trapped between block 31 and outer quill 33. In the illustrated construction, the inner quill 32 is out of contact with the outer quill 33 in each co-axial quill assembly 30. A gaseous fuel conduit 47 is fluidly connected to gaseous fuel passage 46, and also extends between outer surface 63 of inner quill 32 and the inner surface 69 of outer quill 33. Spatial constraints in engine housing 11 may require that an upstream half 49 of the gaseous fuel conduit 47 have a pressure damping chamber 48 with a volume larger than a volume of a downstream half 50 of the gaseous fuel conduit 47. Thus, a majority of the volume of the pressure damping chamber 48 may be located in an upstream half 49 of the gaseous fuel conduit 47 both within outer quill 33 and within quill chamber 52. As stated earlier, the pressure damping chamber 48 should be of sufficient size and shape to damp pressure waves arriving from the gaseous fuel passage 46 in order to reduce variations in gaseous fuel injection rates and quantities. In this specific example, the available space in engine housing 11 may permit the relatively uniform wall thickness of the outer quill 33, which is defined between an inner surface 69 and outer surface 68, to include two step wise diameter reductions 70 along the axis 29 in a direction of second end 67. Nevertheless, other engine housing geometries may vary substantially from that shown. The gaseous rail passage 45 of each block 31 may define a portion of the gaseous fuel common rail 21. Likewise, the liquid rail passage 42 of each block 31 may define a segment of the liquid fuel common rail 22 as best shown in FIGS. 1 and 2.

Referring more specifically to FIG. 4, reliable sealing contact between the co-axial quill assembly 30 and fuel injector 25 against leakage of both gaseous and liquid fuels may be accomplished by tightening only a single fastener 80 to a predetermined torque load. This may be accomplished by locating the gage line 85 at the second end 62 of the inner quill 32 to extend a predetermined target distance Δ beyond the gage line 86 at the second end 67 of the outer quill 33. The gage line 85, 86 is the sealing contact line. A predetermined load may be placed on block 31 by load adjusting clamp 34 acting along axis 29 so that the outer and inner quills 33, 32 seat and sealingly engage on common conical seat 27 at their respective gage lines 85, 86. Tightly controlling the predetermined target distance Δ may be accomplished in a number of ways. In the illustrated embodiment, target distance Δ is held to a tolerance d that is a stack up of tolerance e, β and α. Dimension distance E +/−tolerance e corresponds to the distance between the gage line of conical seat 53 and the shoulder face against which o-ring 73 seals on block 31. Dimension distance B +/−tolerance β corresponds to the distance from the shoulder surface of outer quill 33 to the gage line 86 at second end 67 of outer quill 33. Dimension distance A +/−tolerance α corresponds to the distance between the gage lines 87, 85 at opposite ends of inner quill 32. Provided that the distances A, B and E can be held within reasonable tolerances, the tolerance stack up d on target distance Δ can be made acceptable such that proper sealing at conical seat 27 of fuel injector 25 is reliably made. Tolerance stack up d equals e plus β plus α. During preassembly, the predetermined target distance Δ may be set within an acceptable tolerance d by selecting a block 31 with an appropriate dimension distance E +/−e, an outer quill 33 with an appropriate dimension distance B +/−β, and a inner quill 32 with an appropriate dimension distance A +/−α. Provided that the tolerance stack up of e+β+α yields an acceptable tolerance d, simple nearly fool proof installation may be assured by simply tightening a single fastener 80 to an appropriate torque load to apply an appropriate load along centerline 29.

Those skilled in the art will appreciate that the inner and outer quills 32, 33 may have different spring rates and may require different load levels to ensure proper sealing at common conical seat 27. Therefore, some differential length, which may be positive, negative or zero, depending upon the specific design, quill materials and geometries may need to be added to the above described dimensions in order to ensure proper sealing contact at fuel injector 25.

In order to trap metallic debris often liberated into the fuel flows during the first time operation of engine 10 after being built, co-axial quill assembly 30 may include a gaseous fuel edge filter 36 and a liquid fuel edge filter 37. In the illustrated embodiment, liquid fuel edge filter 37 may be positioned in the liquid fuel conduit 44 defined by inner quill 32. The gaseous fuel edge filter 36 is shown positioned within outer quill 33 between the two step wise diameter reductions 70. In the illustrated embodiment, gaseous fuel edge filer 36 may have a combined dual purpose by including a retainer 38 that can be thought of as in contact with the inner surface 69 of outer quill 33 and of the outer surface 63 of inner quill 32. In this embodiment, retainer 38 may include an o-ring 91 that encourages gaseous fuel traveling along gaseous fuel conduit 47 to move through filter passages 93 between edge filter 36 and outer quill 33 to trap metallic debris upstream from fuel injector 25. The outer surface of retainer 38 includes a plurality of filter passages 93 that are distributed around, and oriented perpendicular to the axis 29. In this embodiment, retainer 38 may comprise a suitable metallic piece, such as steel, that is machined to the shape as shown and also includes an o-ring 91 that grips the outer surface 63 of inner quill 32. Retainer 38 may be connected to the outer quill 33 with a metal to metal interference fit 95.

Because inner quill 32 is unattached to either outer quill 33 or block 31, co-axial quill assembly 30 may include the retainer 38 that is in contact with the outer surface 63 to maintain the inner quill 32 with the block 31 and outer quill 33 during pre-installation handling. In other words, retainer 38 may inhibit inner quill 32 from falling out of outer quill 33 during pre-installation handling. The edge filter 36/retainer 38 of the disclosure allows the co-axial quill assemblies 30 to be preassembled with a precisely predetermined target distance Δ so that installation is made easy and simple without the need for custom adjustments at each co-axial quill assembly 30. In the illustrated embodiment, consistent leak free installation may only require torqueing fastener 80 to a predetermined load, without any other considerations.

Figure 5:
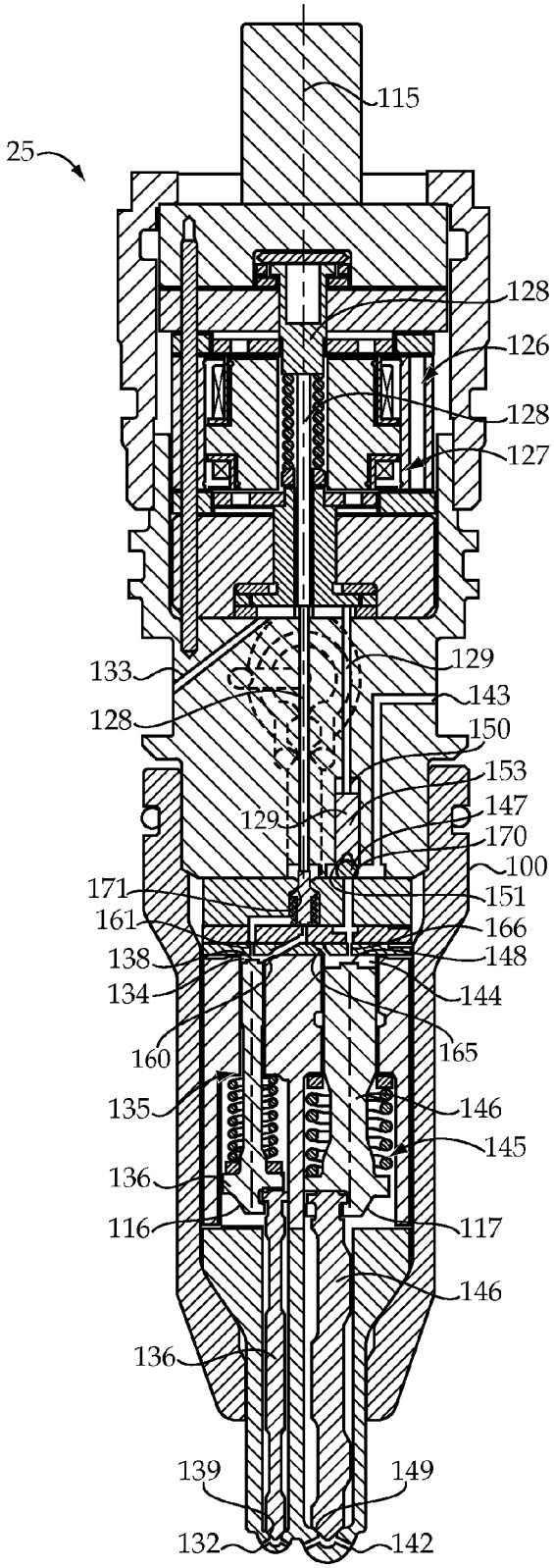
FIG. 5 is a sectioned front diagrammatic view of a fuel injector according to the present disclosure.
Figure 6:
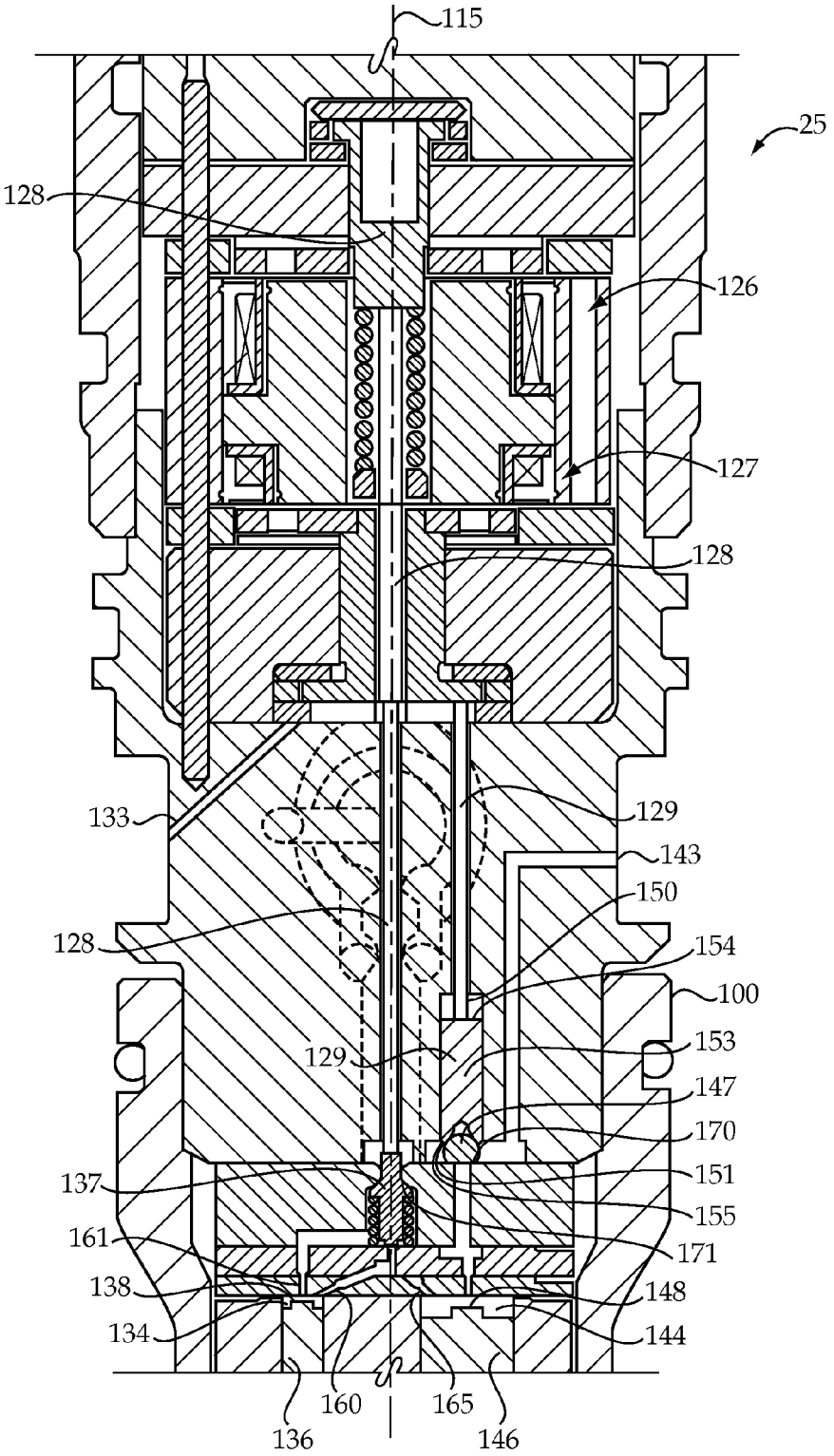
FIG. 6 is an enlarged sectioned front diagrammatic view of the control features of the fuel injector of FIG. 5.

Referring now in addition to FIGS. 5 and 6, each fuel injector 25 includes an injector body 100 that defines a liquid fuel inlet 101 (FIG. 4). A gaseous fuel inlet 102 (FIG. 4) a liquid nozzle outlet set 132 (FIG. 5), a gaseous nozzle outlet set 142 (FIG. 5), a liquid drain outlet 133 (FIGS. 1 and 5) and a gaseous drain outlet 143 (FIGS. 1 and 5). Disposed within each injector body 100 is a liquid control chamber 134 and a gaseous control chamber 144. Each of the fuel injectors 25 includes a liquid direct operated check valve 135 with a liquid check valve number 136, and a gaseous direct operating check valve 145 with a gaseous check valve number 146. Although the liquid check valve number 136 and the gaseous check valve number 146 are shown as made up of two parts, those skilled in the art will appreciate that each of the check valve members 136, 146 could also be made of a unitary body without departing from the intended scope of the present disclosure. In addition, the direct operated checks 135 and 145 are shown in a side-by-side relationship, but coaxial direct operated checks would also fall within the intended scope of the present disclosure. In the illustrated embodiment, liquid check valve member 136 is positioned in parallel with, but spaced apart from gaseous check valve member 146. Also in the illustrated embodiment, the first electrical actuator 126 and the second electrical actuator 127 are solenoids that utilize a shared stator and act along a common centerline 115. Nevertheless, those skilled in the art will appreciate that the two electrical actuators could be piezos and/or be arranged differently, such as in a side-by-side relationship, without departing from the intended scope of the present disclosure.

In the illustrated embodiment, all of the first linkage 128 that operably couples the first electrical actuator 126 to the liquid control valve member 137 is exposed to fluid pressure in liquid drain outlet 133 via passageways that may not be visible in the sectioned views of FIGS. 5 and 6. A part 150 of second linkage 129 that operably couples the second electrical actuator 127 to the gaseous control valve member 147 may also be exposed to fluid pressure in liquid drain outlet 133. However, a remaining part 151 of second linkage 129 may be exposed to fluid pressure in gaseous drain outlet 143. In particular, second linkage 129 may include a piston 153 with a top end exposed to liquid drain pressure in liquid drain outlet 133 via passages not visible in FIGS. 5 and 6, whereas an opposite end of piston 153 may be exposed to fluid pressure in gaseous drain outlet 143 as best shown in FIG. 6. Piston 153 may move with a tight clearance in a bore 154 over a sufficient length to limit substantial leakage along the outer surface of piston 153 between liquid fuel from above and gaseous fuel from below. It might be desirable to maintain the liquid drain outlet 133 pressure slightly higher than the pressure in gaseous drain outlet 143 in order to inhibit migration of gaseous fuel into the liquid side of fuel system 20.

In the illustrated embodiment, both the liquid control valve associated with liquid control valve member 137 and the gaseous control valve associated with gaseous control valve member 147 are two-way valves. Nevertheless, those skilled in the art will appreciate that three-way valves could be substituted in place of either valve without departing from the intended scope of the present disclosure. In the illustrated embodiment, the liquid fuel inlet 101 is always fluidly connected to the liquid control chamber 134 through a Z-orifice 160 and passageways not visible in the sectioned views of FIGS. 5 and 6. When liquid control valve member 137 is in its open position, liquid control chamber 134 becomes fluidly connected to liquid drain outlet 133 through an A-orifice 161. The gaseous side works in a similar manner. In particular, the gaseous fuel inlet 102 is always fluidly connected to the gaseous control chamber 144 through a Z-orifice 165. When the gaseous control valve member moves to its open position, the gaseous control chamber 144 becomes fluidly connected to gaseous drain outlet 143 through an A-orifice 166. Although gaseous control valve member 147 moves into and out of contact with a flat seat 170, those skilled in the art will appreciate that alternatively shaped control valve member that could be utilized that moves into and out of contact with a conical seat without departing from the intended scope of the present disclosure.

The liquid control valve number 137 is operably coupled to a first electrical actuator 126 to control pressure in liquid control chamber 134 to control the timing and duration of liquid injection events through liquid nozzle outlets 132. Likewise, the gaseous control valve member 147 is operably coupled to second electrical actuator 127 to control pressure in gaseous control chamber 144 to control the timing and duration of gaseous injection events through gaseous nozzle outlet set 142.

Each liquid check valve member 136 includes a liquid closing hydraulic surface 138 exposed to fluid pressure in liquid control chamber 134. The liquid check valve member 136 is movable between a closed position as shown in contact with a liquid seat 139 to fluidly block the liquid fuel inlet 101 (FIG. 4) to the liquid nozzle outlet set 132, and an open position out of contact with the liquid seat 139 to fluidly connect the liquid fuel inlet 101 to the liquid nozzle outlet set 132 to facilitate a liquid fuel injection event. The gaseous check valve member 146 includes a gaseous closing pneumatic surface 148 exposed to fluid pressure in gaseous control chamber 144. The gaseous check valve member 146 is movable between a closed position (as shown) in contact with a gaseous seat 149 to fluidly block the gaseous fuel inlet 102 (FIG. 4) to the gaseous nozzle outlet set 142, and an open position out of contact with the gaseous seat 142 to fluidly connect the gaseous fuel inlet 102 to the gaseous nozzle outlet set 142. The liquid control member 137 is normally biased upwards into contact with a conical seat 171 corresponding to a closed position to fluidly block the liquid control chamber 134 to the liquid drain outlet 133. When first electrical actuator 126 is energized, a linkage 128 pushes liquid control valve member 137 out of contact with conical seat 171 to an open position at which the liquid control chamber 134 is fluidly connected to the liquid drain outlet 133 to reduce pressure acting on liquid closing hydraulic surface 138 to facilitate a liquid injection event. Thus, first electrical actuator 126 can be thought of as being operably coupled to liquid control valve member 137. Although liquid control valve member 137 is shown moving into and out of contact with a conical seat 171, those skilled in the art will appreciate that an appropriate control valve member and a flat seat could be substituted without differing from the intended scope of the present disclosure.

The gaseous control valve member 147 is movable between a closed position in contact with a flat seat 170 at which the gaseous control chamber 144 is fluidly blocked to the gaseous drain outlet 143. When second electrical actuator 127 is energized, a second linkage 129 is moved upward allowing gas pressure in gas control chamber 144 to push gas control valve member 147 at a flat seat 170 to an open position at which gaseous control chamber 144 is fluidly connected to gaseous drain outlet 143 to reduce pneumatic pressure acting on closing pneumatic surface 148 to facilitate a gaseous injection event.

Industrial Applicability

The present disclosure finds potential application in any fuel injector that is to be utilized to inject two fuels that differ in at least one of pressure, chemical identity and matter phase. The present disclosure finds specific applicability to dual fuel injectors associated with compression ignition engines to inject liquid diesel fuel at a first pressure, and gaseous fuel (e.g. natural gas) at a second pressure. Finally, the present disclosure finds potential application in dual fuel compression ignition engines that seek to utilize a small injection of liquid diesel fuel that is compression ignited to in turn ignite a larger charge of gaseous fuel. Finally, the present disclosure finds specific applicability to dual fuel common rail systems.

Referring again to all of the FIGS. 1-6, a method of operating dual fuel engine 10 includes injecting liquid fuel through the liquid nozzle outlet set 132 by fluidly connecting the liquid control chamber 134 to the liquid drain outlet 133 past the liquid control valve member 137. Gaseous fuel is injected through the gaseous nozzle outlet set 142 by fluidly connecting the gaseous control chamber 144 to the gaseous drain outlet 143 past the gaseous control valve member 147. Each liquid fuel injection event is ended by blocking the liquid control chamber 134 from the liquid drain outlet 133 with the liquid control valve member 137. Likewise, gaseous fuel injection events are ended by blocking the gaseous control chamber 144 to the gaseous drain outlet 143 with the gaseous control valve member 147. During and between liquid fuel injection events, the liquid fuel common rail 22 is fluidly connected to the liquid control chamber 134 through Z-orifice 160. Likewise, during and between gaseous fuel injection events, the gaseous fuel common rail 21 is fluidly connected to the gaseous control chamber 144 through Z-orifice 165. During gaseous fuel injection events, the amount of gaseous fuel used with the control function is moved from gaseous drain outlet 143 toward, and eventually into, intake manifold 13 for burning as circumstances permit, rather than being vented to atmosphere.

Each liquid injection event is facilitated by hydraulically pushing on a hydraulic opening surface 116 of liquid check valve member 136 toward an open position with liquid pressure from the liquid fuel common rail 22. Likewise, gaseous fuel injection events are facilitated by pneumatically pushing on an opening pneumatic 117 of the gaseous check valve member 146 toward its open position with gaseous pressure from gaseous fuel common rail 21. Thus, between liquid injection events, both ends of the liquid check valve member 136 are exposed to fluid pressure in the liquid fuel common rail 22. Likewise, between injection events both ends of the gaseous check valve member 146 are exposed to fluid pressure in gaseous fuel common rail 21. This construction may eliminate a potential need for a hydraulic lock feature associated with the check valve member 146 to inhibit exchange or leakage of gaseous fuel into the liquid side of fuel system 20. The gaseous check valve member 146 may also be fluidly isolated from both the liquid fuel inlet 101 and the liquid drain outlet 133. Likewise, the liquid check valve member 136 may be fluidly isolated from both the gaseous fuel inlet 102 and the gaseous fuel drain outlet 143. Separation of the two fuels is partially accomplished by exposing all of the first linkage 128 that operably couples the first electrical actuator 126 to the liquid control valve member 137. Part 150 of the second linkage 129 that operably couples the second electrical actuator 127 to the gaseous control valve member 147 is likewise exposed to fluid pressure in liquid drain outlet 133. However, the remaining part 151 of the second linkage 129 is exposed to fluid pressure in the gaseous drain outlet 143. It is these features that help maintain the two fuels isolated and inhibit leakage between the same during normal operation of engine 10.

The fuel injector 25 of the present disclosure utilize liquid as the control fluid at the check top on the liquid side, but utilize gas as the control fluid at the check top of the gas side. This feature helps eliminate the potential need for a hydraulic lock mechanism since gas is used on both sides of the gaseous check valve member 146. Also, due to the fact that gas is used as the control fluid for gaseous injection events, the gas injection events are insensitive to fluctuations in liquid rail pressure. Hence, even a small pilot liquid injection event prior to a gas injection event may not cause much shot-to-shot variation in gaseous fuel delivery than might what occur if liquid fuel were used as a control fluid for both liquid and gaseous fuel injection events. During normal operation, one might expect the liquid common rail 22 to be maintained at a higher pressure than the gaseous fuel common rail 21. For instance, these pressures might be 35 and 30 MPa, respectively. On the other hand, if the engine 10 is operating in a so called limp-home mode in which only liquid fuel is injected, the liquid rail pressure may be increased to about 100 MPa, while the gaseous side of the fuel system 20 may be reduced to gaseous drain pressure. Because of the fluid isolation features taught in the present disclosure, the separation of the two fuels made maintained when operating in a normal mode and when in operating in a limp-home mode. Thus, even during limp-home mode, the fluid isolation feature of the present disclosure may inhibit leakage of liquid diesel fuel into the gaseous supply and drain side of fuel system 20.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A dual fuel injector comprising:

an injector body that defines a liquid fuel inlet, a gaseous fuel inlet, a liquid nozzle outlet set, a gaseous nozzle outlet set, a liquid drain outlet and a gaseous drain outlet, and having disposed therein a first control chamber and a second control chamber;

a liquid direct operating check valve with a liquid check valve member positioned in the injector body with a closing hydraulic surface exposed to fluid pressure in the first control chamber, and being movable between a closed position in contact with a first seat to fluidly block the liquid fuel inlet to the liquid nozzle outlet set, and an open position out of contact with the first seat to fluidly connect the liquid fuel inlet to the liquid nozzle outlet set;

a gaseous direct operating check valve with a gaseous check valve member positioned in the injector body with a closing pneumatic surface exposed to fluid pressure in the second control chamber, and being movable between a closed position in contact with a second seat to fluidly block the gaseous fuel inlet to the gaseous nozzle outlet set, and an open position out of contact with the second seat to fluidly connect the gaseous fuel inlet to the gaseous nozzle outlet set;

a first control valve member movable between a closed position at which the first control chamber is fluidly blocked to the liquid drain outlet, and an open position at which the first control chamber is fluidly connected to the liquid drain outlet;

a second control valve member movable between a closed position at which the second control chamber is fluidly blocked to the gaseous drain outlet, and an open position at which the second control chamber is fluidly connected to the gaseous drain outlet; and wherein the liquid check valve member is fluidly isolated from both the gaseous fuel inlet and the gaseous drain outlet.

2. The dual fuel injector of claim 1 including a first electrical actuator operably coupled to the first control valve member;

a second electrical actuator operably coupled to the second control valve member;

the first electrical actuator and the second electrical actuator share a common centerline.

3. The dual fuel injector of claim 1 wherein the liquid check valve member is positioned in parallel with, but spaced apart from, the gaseous check valve member.

4. The dual fuel injector of claim 1 wherein the liquid fuel inlet is always fluidly connected to the first control chamber through a first Z orifice; and the gaseous fuel inlet is always fluidly connected to the second control chamber through a second Z orifice.

5. The dual fuel injector of claim 1 wherein the liquid fuel inlet and the gaseous fuel inlet open through a common conical seat.

6. The dual fuel injector of claim 1 wherein at least one of the first and second control valve member moves into and out of contact with a flat seat at the closed and open positions, respectively.

7. The dual fuel injector of claim 1 wherein all of a first linkage operably coupling the first electrical actuator to the first control valve member, and part of a second linkage operably coupling the second electrical actuator to the second control valve member, are exposed to a fluid pressure in the liquid drain outlet; and a remaining part of the second linkage being exposed to fluid pressure of the gaseous drain outlet.

8. A compression ignition dual fuel engine comprising:

an intake manifold fluidly connected to a plurality of engine cylinders;

a plurality of fuel injectors, each positioned for direct injection into one engine cylinder of the plurality of engine cylinders, and each of the fuel injectors including an injector body that defines a liquid fuel inlet, a gaseous fuel inlet, a liquid nozzle outlet set, a gaseous nozzle outlet set, a liquid drain outlet and a gaseous drain outlet, and having disposed therein a liquid control chamber and a gaseous control chamber; and further including a liquid direct operating check valve with a liquid check valve member, a gaseous direct operating check valve with a gaseous check valve member, a liquid control valve member and a gaseous control valve member;

a gaseous fuel common rail fluidly connected to the plurality of fuel injectors;

a liquid fuel common rail fluidly connected to the plurality of fuel injectors;

a gaseous fuel supply and pressure control system fluidly connected to the gaseous fuel common rail;

a liquid fuel supply and pressure control system fluidly connected to the liquid fuel common rail;

each of the fuel injectors having a gaseous drain outlet being fluidly connected to the intake manifold;

each of the fuel injectors having a liquid drain outlets being fluidly connected to the liquid fuel supply and pressure control system; and an electronic controller in control communication with each of the plurality of fuel injectors, the liquid fuel supply and pressure control system, and the gaseous fuel supply and pressure control system.

9. The compression ignition dual fuel engine of claim 8 including a valve fluidly positioned between the gaseous drain outlet and the intake manifold.

10. The compression ignition dual fuel engine of claim 9 wherein the liquid check valve member has a liquid closing hydraulic surface exposed to fluid pressure in the liquid control chamber, and being movable between a closed position in contact with a liquid seat to fluidly block the liquid fuel inlet to the liquid nozzle outlet set, and an open position out of contact with the liquid seat to fluidly connect the liquid fuel inlet to the liquid nozzle outlet set;

the gaseous check valve member has a gaseous closing pneumatic surface exposed to fluid pressure in the gaseous control chamber, and being movable between a closed position in contact with a gaseous seat to fluidly block the gaseous fuel inlet to the gaseous nozzle outlet set, and an open position out of contact with the gaseous seat to fluidly connect the gaseous fuel inlet to the gaseous nozzle outlet set;

the liquid control valve member is movable between a closed position at which the liquid control chamber is fluidly blocked to the liquid drain outlet, and an open position at which the liquid control chamber is fluidly connected to the liquid drain outlet; and the gaseous control valve member is movable between a closed position at which the gaseous control chamber is fluidly blocked to the gaseous drain outlet, and an open position at which the gaseous control chamber is fluidly connected to the gaseous drain outlet.

11. The compression ignition dual fuel engine of claim 10 wherein the liquid fuel inlet is always fluidly connected to the liquid control chamber through a first Z orifice;

the gaseous fuel inlet is always fluidly connected to the gaseous control chamber through a second Z orifice; and at least one of the liquid and gaseous control valve member moves into and out of contact with a flat seat at the closed and open positions, respectively.

12. The compression ignition dual fuel engine of claim 11 wherein each of the fuel injectors includes:

a first electrical actuator operably coupled to the liquid control valve member;

a second electrical actuator operably coupled to the gaseous control valve member;

the first electrical actuator and the second electrical actuator share a common centerline;

all of a first linkage operably coupling the first electrical actuator to the liquid control valve member, and part of a second linkage operably coupling the second electrical actuator to the gaseous control valve member, are exposed to a fluid pressure in the liquid drain outlet; and a remaining part of the second linkage being exposed to fluid pressure of the gaseous drain outlet.

13. The compression ignition dual fuel engine of claim 12 wherein the liquid check valve member is positioned in parallel with, but spaced apart from, the gaseous check valve member.

14. The compression ignition dual fuel engine of claim 13 wherein the liquid fuel inlet and the gaseous fuel inlet open through a common conical seat for each of the fuel injectors.

15. A method of operating a dual fuel engine with an intake manifold fluidly connected to a plurality of engine cylinders; a plurality of fuel injectors, each positioned for direct injection into one engine cylinder of the plurality of engine cylinders, and each of the fuel injectors including an injector body that defines a liquid fuel inlet, a gaseous fuel inlet, a liquid nozzle outlet set, a gaseous nozzle outlet set, a liquid drain outlet and a gaseous drain outlet, and having disposed therein a liquid control chamber and a gaseous control chamber; and further including a liquid direct operating check valve with a liquid check valve member, a gaseous direct operating check valve with a gaseous check valve member, a liquid control valve member and a gaseous control valve member; a gaseous fuel common rail fluidly connected to the plurality of fuel injectors; a liquid fuel common fluidly connected to the plurality of fuel injectors; a gaseous fuel supply and pressure control system fluidly connected to the gaseous fuel common rail; a liquid fuel supply and pressure control system fluidly connected to the liquid fuel common rail; each of the fuel injectors having a gaseous drain outlet fluidly connected to the intake manifold; each of the fuel injectors having a liquid drain outlet fluidly connected to the liquid fuel supply and pressure control system; and an electronic controller in control communication with each of the plurality of fuel injectors, the liquid fuel supply and pressure control system, and the gaseous fuel supply and pressure control system, the method comprising the steps of:

injecting liquid fuel through the liquid nozzle outlet set by fluidly connecting the liquid control chamber to the liquid drain outlet past the liquid control valve member;

injecting gaseous fuel through the gaseous nozzle outlet set by fluidly connecting the gaseous control chamber to the gaseous drain outlet past the gaseous control valve member.

16. The method of claim 15 including the step of ending a liquid fuel injection event by blocking the liquid control chamber from the liquid drain outlet with the liquid control valve member; and ending a gaseous fuel injection event by blocking the gaseous control chamber from the gaseous drain outlet with the gaseous control valve member.

17. The method of claim 16 including the step of fluidly connecting the liquid fuel common rail to the liquid control chamber through a Z orifice during and between liquid fuel injection events; and fluidly connecting the gaseous fuel common rail to the gaseous control chamber through a Z orifice during and between gaseous fuel injection events.

18. The method of claim 17 including a step of moving gaseous fuel from the gaseous fuel drain outlets into the intake manifold.

19. The method of claim 18 wherein the step of injecting liquid fuel includes hydraulically pushing the liquid check valve member toward the open position with liquid pressure from the liquid fuel common rail; and the step of injecting gaseous fuel includes pneumatically pushing the gaseous check valve member toward the open position with gaseous pressure from the gaseous fuel common rail.

20. The method of claim 19 including a step of fluidly isolating the gaseous check valve member from both the liquid fuel inlet and the liquid drain outlet;

exposing all of a first linkage operably coupling the first electrical actuator to the liquid control valve member, and part of a second linkage operably coupling the second electrical actuator to the gaseous control valve member, to a fluid pressure in the liquid drain outlet; and exposing a remaining part of the second linkage being to fluid pressure of the gaseous drain outlet.

* * * * *